US012655726B2

(12) United States Patent
Neal et al.

(10) Patent No.: US 12,655,726 B2
(45) **Date of Patent: *Jun. 16, 2026**

(54) GRAVEL PACK SERVICE TOOL BACK PRESSURE VALVE

(71) Applicant: Halliburton Energy Services, Inc., Houston, TX (US)

(72) Inventors: Jonathon Franklin Neal, Carrollton, TX (US); Gary J. Geoffroy, Carrollton, TX (US); Ping Chew Chay, Negara Brunei (BN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/306,935

(22) Filed: Aug. 21, 2025

(65) Prior Publication Data

US 2026/0055680 A1 Feb. 26, 2026

Related U.S. Application Data

(60) Provisional application No. 63/689,326, filed on Aug. 30, 2024, provisional application No. 63/686,580, filed on Aug. 23, 2024.

(51) Int. Cl.
*E21B 43/04* (2006.01)
*E21B 34/06* (2006.01)
(Continued)

(52) U.S. Cl.
CPC ..... *E21B 43/045* (2013.01); *E21B 34/10* (2013.01); *E21B 34/142* (2020.05); *E21B 37/00* (2013.01); *E21B 34/063* (2013.01)

(58) Field of Classification Search
CPC ..... E21B 34/10; E21B 34/142; E21B 43/045; E21B 34/063; E21B 37/00
See application file for complete search history.

(56) References Cited

U.S. PATENT DOCUMENTS 4,635,725 A 1/1987 Burroughs
4,638,859 A * 1/1987 Zunkel ..... E21B 43/045 166/126

(Continued)

FOREIGN PATENT DOCUMENTS

| | | |
|---|---|---|
| EP | 2447468 | 5/2012 |
| WO | 2016182451 | 11/2016 |
| WO | 2023200751 | 10/2023 |

OTHER PUBLICATIONS

"PCT Application No. PCT/US2025/043059 International Search Report and Written Opinion", Dec. 18, 2025, 12 pages.

(Continued)

*Primary Examiner* — Theodore N Yao
(74) *Attorney, Agent, or Firm* — DeLizio, Peacock, Lewin & Guerra LLP

(57) ABSTRACT

An apparatus comprises a service tool configured to be deployed in a wellbore as part of a managed pressure drilling operation of the wellbore, wherein an annulus is defined between a wall of the wellbore and a work string that includes the service tool, a drill pipe, and a lower completion, the service tool comprising, a crossover port; and a valve configured to maintain a back side pressure in the annulus without pressurizing the work string.

21 Claims, 16 Drawing Sheets

(51) Int. Cl.

| | |
|---|---|
| ***E21B 34/10*** | (2006.01) |
| ***E21B 34/14*** | (2006.01) |
| ***E21B 37/00*** | (2006.01) |

(56) References Cited

U.S. PATENT DOCUMENTS

| | | | | |
|---|---|---|---|---|
| 6,216,785 | B1 * | 4/2001 | Achee, Jr. | E21B 43/10 166/278 |
| 7,383,884 | B1 | 6/2008 | Turner et al. | |
| 7,712,524 | B2 | 5/2010 | Patel et al. | |
| 7,918,276 | B2 | 4/2011 | Guignard et al. | |
| 8,496,055 | B2 | 7/2013 | Mootoo et al. | |
| 9,085,960 | B2 | 7/2015 | Van Petegem et al. | |
| 11,118,424 | B2 | 9/2021 | Greci et al. | |
| 11,333,005 | B2 | 5/2022 | Provost et al. | |
| 12,000,273 | B2 | 6/2024 | Yi et al. | |
| 12,078,036 | B2 | 9/2024 | Poizat et al. | |
| 2002/0036087 | A1 * | 3/2002 | Bixenman | E21B 34/12 166/278 |
| 2004/0069489 | A1 | 4/2004 | Corbett | |
| 2009/0025923 | A1 * | 1/2009 | Patel | E21B 43/045 166/278 |
| 2009/0145603 | A1 | 6/2009 | Coronado | |
| 2010/0163235 | A1 * | 7/2010 | Mootoo | E21B 21/10 166/278 |
| 2014/0251609 | A1 | 9/2014 | Broussard et al. | |
| 2016/0362960 | A1 * | 12/2016 | Ross | E21B 34/10 |
| 2017/0218723 | A1 | 8/2017 | Brasseaux | |
| 2019/0178052 | A1 | 6/2019 | Giroux et al. | |

OTHER PUBLICATIONS

"PCT Application No. PCT/US2025/043060 International Search Report and Written Opinion", Dec. 26, 2025, 12 pages.
"U.S. Appl. No. 19/306,927 Non-Final Office Action", Apr. 3, 2026, 10 pages.

* cited by examiner

GRAVEL PACK SERVICE TOOL BACK PRESSURE VALVE

BACKGROUND

Conventional drilling techniques control pressure inside the wellbore by utilizing the hydrostatic pressure generated by drilling fluid circulated through the well. When using only hydrostatic pressure to control wellbore pressure, it can be difficult to compensate for pressure changes because pressure in the wellbore may be adjusted only by changing the density or specific gravity of the drilling fluid, or by adjusting the mud pump circulation rate. However, these methods are incapable of addressing sudden unexpected changes in pressure, as circulation rate induced pressure changes are small, and it can take hours to change the makeup of the drilling fluid. Newer techniques, such as underbalanced drilling and managed pressure drilling, address this problem by closing the annulus and utilizing pressure management devices to control wellbore pressure.

BRIEF DESCRIPTION OF THE DRAWINGS

Embodiments of the disclosure may be better understood by referencing the accompanying drawings.

DESCRIPTION

Figure 1:
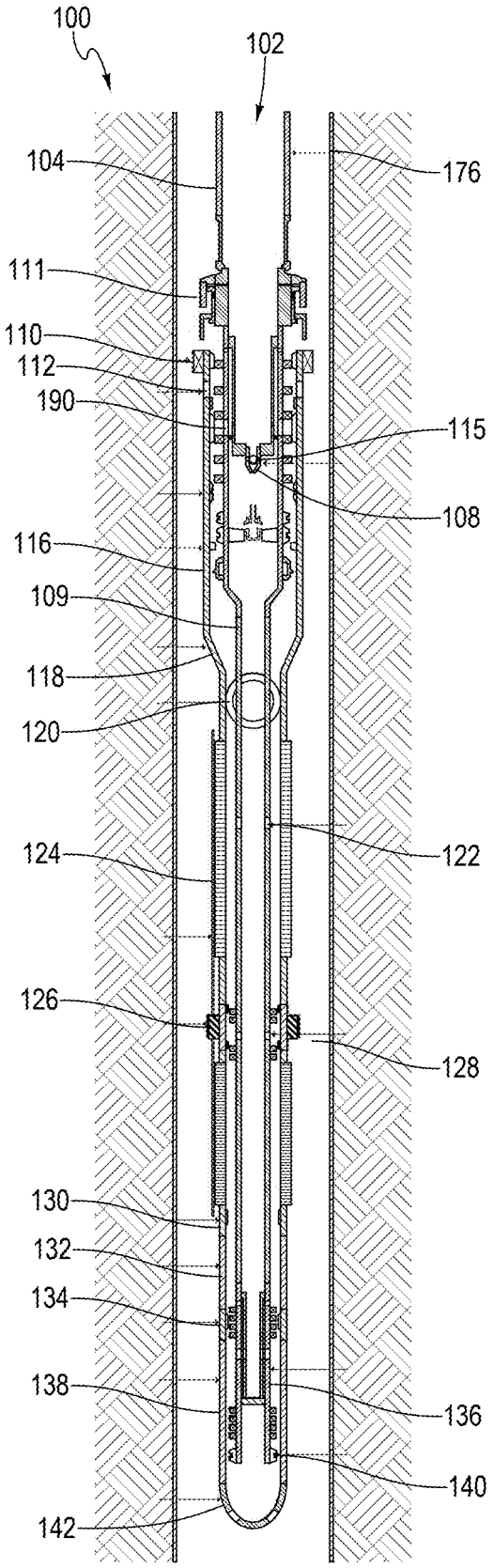
FIG. 1 is a cross sectional diagram of an open hole gravel pack (OHGP) system for managed pressure drilling (MPD) applications that includes a back pressure valve positioned beneath crossover ports, according to some implementations.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Example implementations may include managed pressure drilling operations downhole in a wellbore. Example implementations address the challenge of a method to perform open hole gravel packs with managed pressure drilling. In some implementations, the method may incorporate an additional module to the open hole gravel pack system. This additional module may include a circulation device in the wash pipe that enables deployment in a managed pressure drilling mode, setting of the gravel pack packer/open isolation packer, gravel packing with or without managed pressure drilling, and conducting post-gravel pack treatment in a single trip.

Example implementations may incorporate an additional back pressure valve beneath the crossover port assembly (crossover ports) of a gravel pack service tool of the work string. This valve allows the applied backpressure from managed pressure drilling to be maintained without affecting the standard open gravel pack system's functionality. This includes forward circulation as needed, setting packers (including open hole isolation packer), gravel packing, reverse out and post gravel pack treatment capabilities. In some implementations, this back pressure valve is positioned below the crossover ports to prevent this back pressure valve from interfering with the gravel pack operations while still providing the needed functionality of maintaining back pressure (as described herein).

In contrast to example implementations, conventional approaches use a valve in the work string which, when opened by pressure, could potentially surge the formation with the applied pressure. Once opened, the system loses the ability to continue in managed pressure drilling mode. Another conventional approach may include a retrievable back pressure valve installed in the work string. It requires intervention (multiple trips) and could potentially introduce restrictions in the work string from the nipple profile.

Example implementations may include a single-trip deployment that minimizes the number of trips needed to deploy and gravel pack in Managed Pressure Drilling (MPD). Particularly in long extended-reach and low Equivalent Circulating Density (ECD) wells. Utilizing a single-trip open hole gravel pack MPD system may reduce costs (including capital expenditures). Example implementations may, thus, include a back pressure valve to maintain pressure downhole to prevent the surrounding subsurface formation from collapsing into the wellbore.

Accordingly, example implementations enable both maintaining of the back pressure downhole via the back pressure valve while also allowing for a wash down through the work string via the same back pressure valve. Therefore, this valve allows for fluid to flow down through the work string to allow for the washdown but this same valve serves as a check valve to stop fluid flow in the opposite direction (back uphole) so that the pressure on the backside will stop at this valve. This back pressure maintains the pressure on the formation-precluding a collapsing of this formation in this open hole wellbore. This maintaining of the backpressure via the backpressure valve allows drill pipe to continue to be safely added.

Accordingly and in contrast to conventional approaches, this back pressure valve is a valve that continues to provide the back pressure across any number of circulations. Example implementations may provide a single trip MPD deployment with a multiple pump through capability. Example implementations may allow for the setting of the packers, the gravel pack (with or without a circulation device in the wash pipe), and treat the formations based on a single trip MPD deployment while providing the needed back pressure during such operations.

While described in reference to using a back pressure valve, some implementations may incorporate other types of valves. For example, in some implementations, a pre-programmed, remotely operated valve may be used. Example implementations may include incorporation of a back pressure valve (a spring loaded poppet) beneath the crossover ports of a gravel pack service tool of a work string that is to be positioned downhole in a wellbore as part of hydrocarbon recovery operations. For example, the back pressure valve may be a spring-loaded poppet. This back pressure valve for a gravel pack service tool may maintain the applied pressure from below without affecting the existing functionality of the plug in a gravel pack service tool. Additionally, some implementations may allow maintenance of applied pressure from below in both the run in hole (RIH) scenario (when required) and once the service tool is released from the gravel pack packer (when required).

A conventional approach may include a plug. With this conventional approach, the plug should be able to hold back pressure but needs a separate trip to retrieve for circulation or packer setting (assuming it's installed in the drill pipe). Another conventional approach would include a remotely operated electro-mechanical ball valve that is based on a pre-programmed setting to open/close the valve (such as a timer). In contrast, some implementations may use mechanical manipulation that allows for more flexibility from an operational standpoint.

Example implementations may allow for existing features of a single trip gravel pack and treat service tool with the addition of maintaining back-side pressure when needed. Such implementations may reduce rig-time as well as the associated costs associated with wellbore operations.

Accordingly, example implementations may incorporate an additional back pressure valve beneath the crossover ports of a gravel pack service tool of the work string. This valve allows the applied backpressure from managed pressure drilling to be maintained without affecting the standard open gravel pack system's functionality. This includes forward circulation as needed, setting packers (including open hole isolation packer), gravel packing, reverse out and post gravel pack treatment capabilities. In some implementations, this back pressure valve is positioned below the crossover ports to prevent this back pressure valve from interfering with the gravel pack operations while still providing the needed functionality of maintaining back pressure (as described herein).

Example MPD Configurations

FIG. 1 is a cross sectional view an open hole gravel pack (OHGP) system for managed pressure drilling (MPD) applications that includes a back pressure valve positioned beneath crossover ports, according to some implementations. FIG. 1 depicts a system 100 for MPD applications being deployed in a wellbore 102. There is also a casing 176 of at least a portion of the wellbore 102. The system 100 includes a work string that may include a drill pipe 104, a service tool, and lower completion equipment (lower completion). The lower completion equipment includes a gravel pack packer 110, MCS ports 112, a positioning nipple 114, a coupling 116, a makeup sub 118, a fail safe 120, a shunt screen assembly 124, an open hole isolation packer 126, a polish nipple 130, a pup joint 132, a polish nipple 134, a pup joint 138, and a float shoe 142. The service tool includes a back pressure valve 108, a diverter valve 122, a seal assembly 128, a seal assembly 136, and a shifter 140. The system 100 also includes crossover ports 190. In this position (RIH), the crossover ports 190 are isolated by seals in a sealbore. In subsequent figures (when the service tool is picked up, the crossover ports 190 are no longer isolated and the flow through the work string may go out of the crossover ports 190 and then out the MCS ports 112 for the gravel packing operation. Additionally, during the reversing operation, the crossover ports 190 are picked up above the gravel pack packer 110 to facilitate a flow path for reversing out the excess slurry pumping down the annulus, through the crossover ports 190 and back up the work string. An annulus 111 is defined between a wall of the wellbore and the work string (the drill pipe 104, the service tool and the lower completion. The service tool may carry the lower completion equipment into the wellbore. The service tool includes a hydraulic section that sets the gravel pack packer 110, the seals, the crossover ports 190, the back pressure valve 108, the wash pipe 109, etc.

FIGS. 2-9 are cross sectional diagrams of an OHGP MPD system during all of the operational steps required and that includes a back pressure valve positioned beneath crossover ports, according to some implementations. In particular, FIGS. 2-9 illustrate the operational sequence of OHGP MPD. During MPD deployment, the applied pressure will be monitored beneath the crossover ports and backpressure valve. This may halt communication to the work string/surface (allowing the continued make up of the work string at the surface for safe deployment and RIH). Placing a back pressure valve below the crossover ports will not limit flow and/or obstruct the path of the gravel pack slurry.

Figure 2:
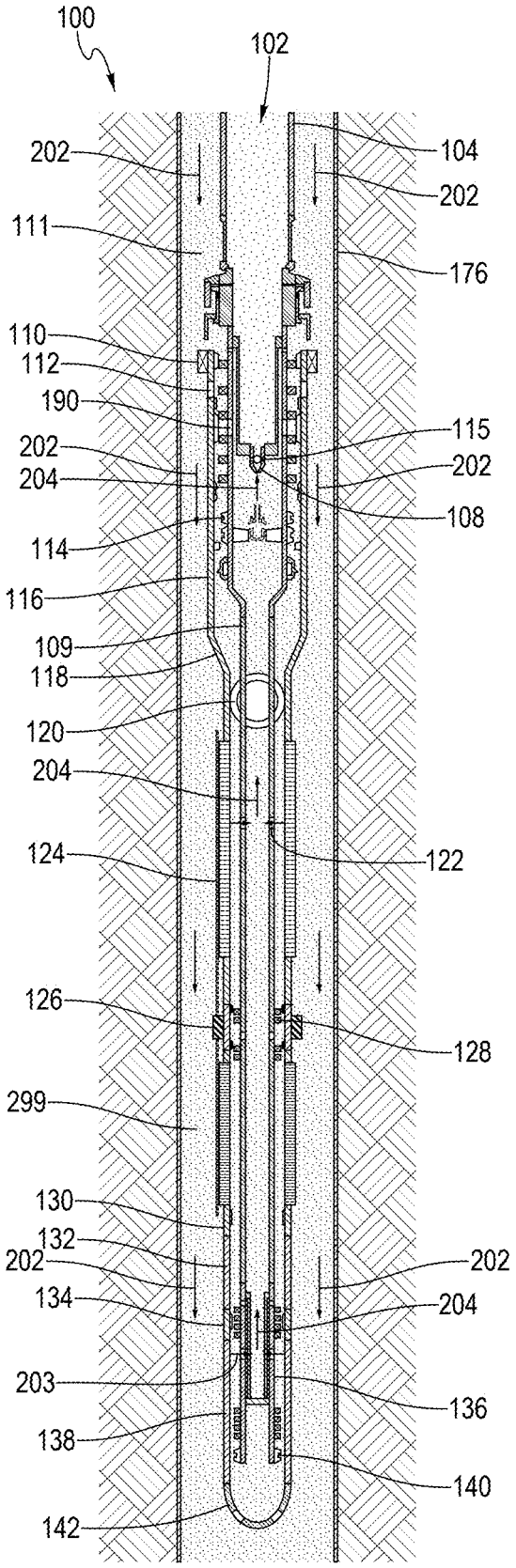
FIG. 2 is a cross sectional diagram of an OHGP MPD system of FIG. 1 during Run In Hole (RIH) and that includes a back pressure valve positioned beneath crossover ports, according to some implementations.

FIG. 2 is a cross sectional diagram of the OHGP MPD system of FIG. 1 during Run In Hole (RIH) and that includes a back pressure valve positioned beneath crossover ports, according to some implementations. As shown in FIG. 2, there is a fluid flow 202 down through the annulus 111 and back up the wash pipe 109. The fluid flow 202 then enters the wash pipe 109 at a port 203. A fluid flow 204 then travels back up the wash pipe 109 and is stopped at the back pressure valve 108 (which is currently closed by the object 115). Thus, the back pressure valve 108 prevents this flow from returning up through the drill pipe 104.

Additionally, there is an annulus pressure in the wellbore 102. There is a hydrostatic pressure in an area in the wellbore 102 that includes the area within the drill pipe 104 above the back pressure valve 108. Additionally, during MPD deployment, an applied pressure (an annulus pressure) 299 may be monitored beneath the crossover ports 190 and the back pressure valve 108. This back pressure valve 108 halts fluid flow through the drill pipe 104 and back up to a surface of the wellbore 102 (thereby allowing the continued make up of the work string at the surface for safe deployment and RIH).

Figure 3:
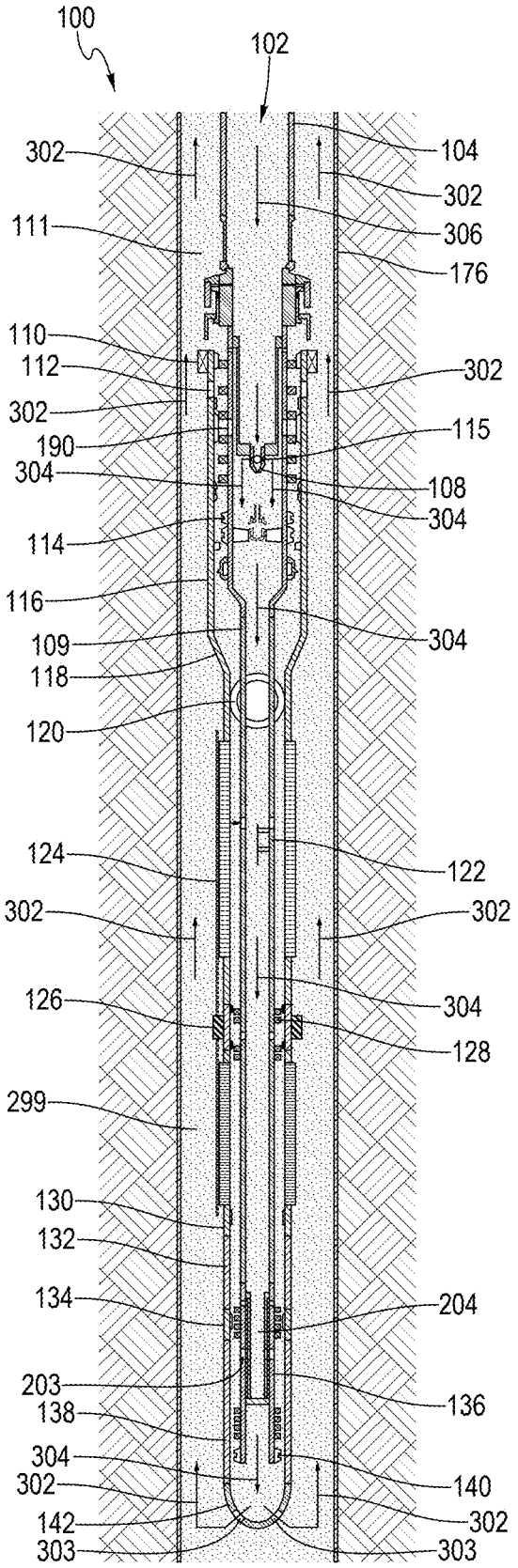
FIG. 3 is a cross sectional diagram of the OHGP MPD system of FIG. 21 that illustrates displacing the open hole, according to some implementations.

FIG. 3 is a cross sectional diagram of the OHGP MPD system of FIG. 1 that illustrates displacing the open hole via forward circulation, according to some implementations. In particular, forward circulation may be needed to address one or more wellbore issues (such as well control, displacement, washdown, etc.). If forward circulation is needed, a fluid may be pumped down through the work string to open the back pressure valve 108.

In FIG. 3, this fluid flow is shown by a fluid flow 306 down through the drill pipe 104 to cause the back pressure valve 108 to open-thereby causing a fluid flow 304 down through the back pressure valve 108 down through the wash pipe 109 below. The fluid flow 304 then flows out of a port 303 at the bottom of the lower completion and out into the annulus 111 (shown as a fluid flow 302). Such a forward circulation down through the work string may resolve the wellbore issue without any intervention or applied opening pressure. In some implementations, the back pressure valve may return to maintain back pressure for MPD deployment once forward circulation ceased (as this may be applied multiple times).

Figure 4:
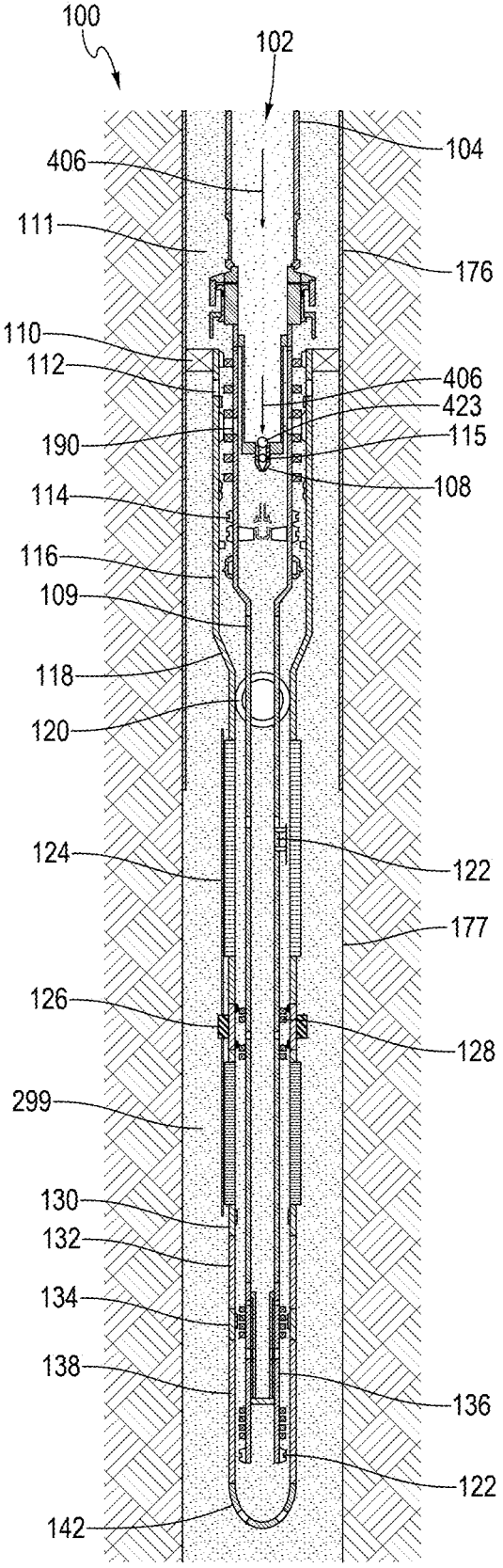
FIG. 4 is a cross sectional diagram of the OHGP MPD system of FIG. 1 that illustrates setting a gravel pack packer, according to some implementations.

FIG. 4 is a cross sectional diagram of the OHGP MPD system of FIG. 1 that illustrates setting a gravel pack packer, according to some implementations. In particular, in FIG. 4, a setting depth in the wellbore 102 for the gravel pack packer 110 has been reached. FIG. 4 also depicts a wall 177 (not cased) of the wellbore 102. After reaching the setting depth, the back pressure valve 108 may be closed. For example, a setting object (e.g., a ball) 423 is included in fluid flow 406 (that flows down through the drill pipe 104) so that the setting object 423 is dropped onto the back pressure valve 108 to close the back pressure valve 108. When the setting object 423 reaches the ball seat above the back pressure valve 108, the pressure above the back pressure valve 108 may be built or maintained to set the packer. i.e. inner diameter of the drill pipe 104 and part of the service tool above the back pressure valve 108 may maintain and hold pressure to set packer. Additionally, the pressure in the area (that includes the annulus 111 and within the lower completion equipment and service tool below the back pressure valve 108) remains unchanged (the annulus pressure). Also, after reaching the setting depth, the gravel pack packer 110 is set.

Figure 5:
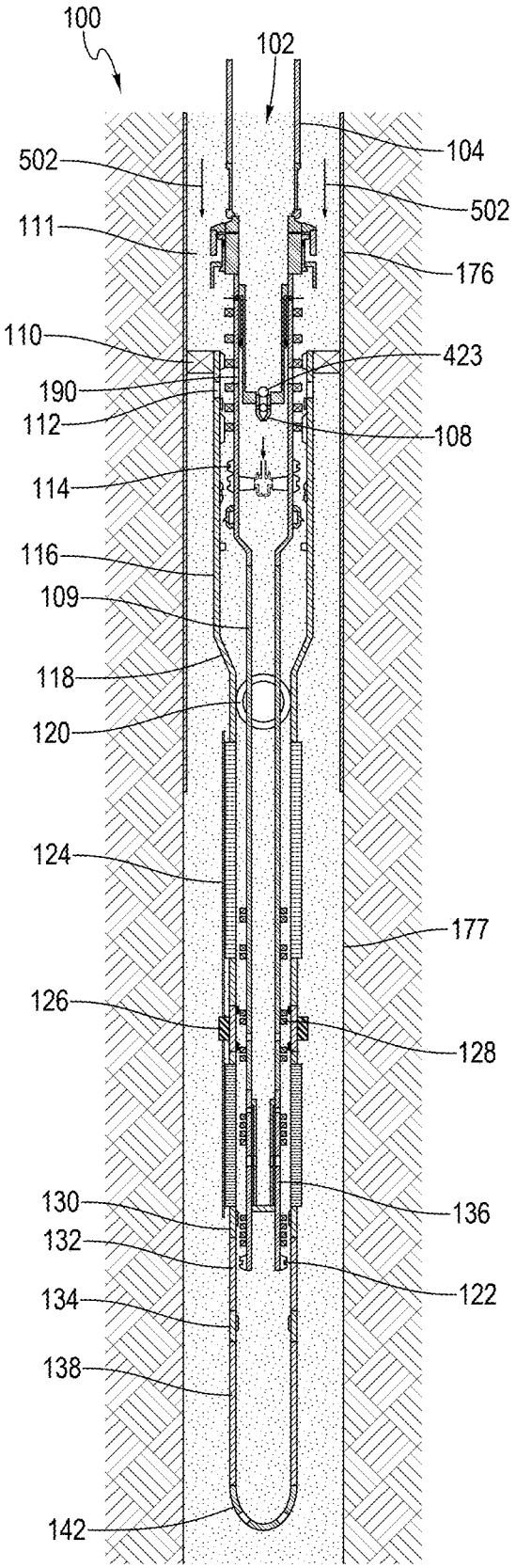
FIG. 5 is a cross sectional diagram of the OHGP MPD system of FIG. 1 that illustrates testing the gravel pack packer, according to some implementations.

FIG. 5 is a cross sectional diagram of the OHGP MPD system of FIG. 1 that illustrates testing the gravel pack packer, according to some implementations. Such testing ensures that the gravel pack packer is properly set. In particular, a fluid flow 502 flows down the annulus 111 from a surface of the wellbore 102 to ensure that the gravel pack packer 110 is properly set against the wall of the casing 176.

Figure 6:
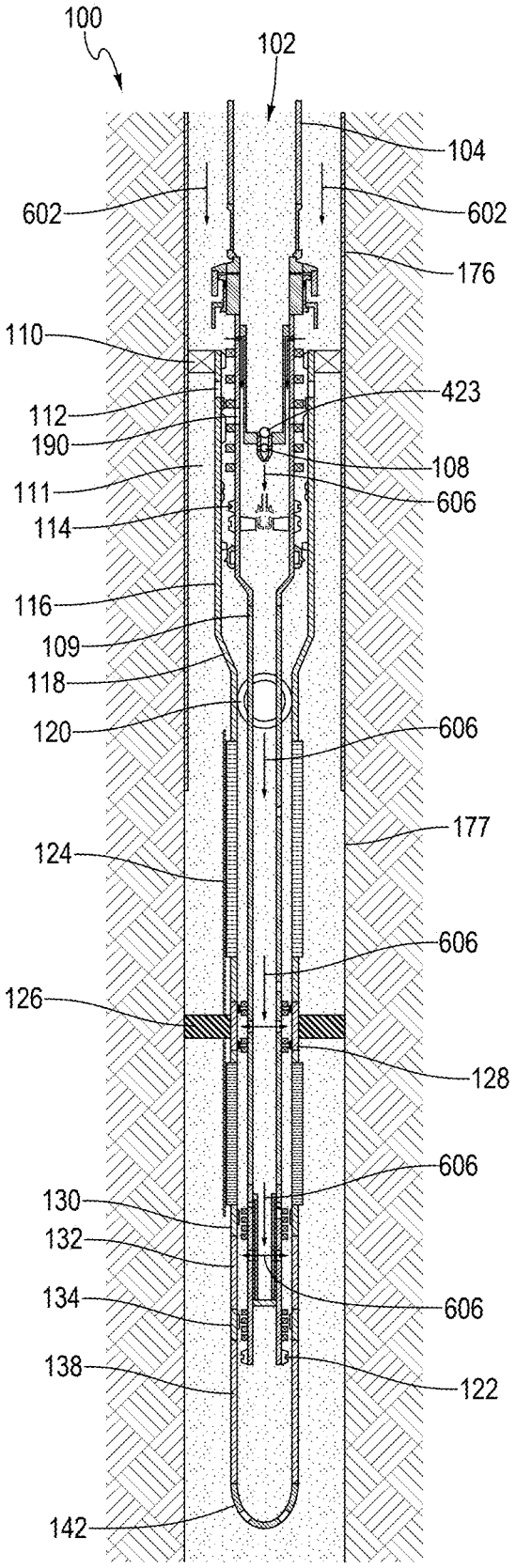
FIG. 6 is a cross sectional diagram of the OHGP MPD system of FIG. 1 that illustrates setting an open hole isolation packer, according to some implementations.

FIG. 6 is a cross sectional diagram of the OHGP MPD system of FIG. 1 that illustrates setting an open hole isolation packer, according to some implementations. The open hole isolation packer 126 is set against the wall 177 of the wellbore 102. Additionally, the back pressure valve 108 maintains the back pressure while the open hole isolation packer 126 is being set. FIG. 6 also depicts a fluid flow 602 down the annulus 111 above the gravel pack packer 110 that has been set and a fluid flow 606.

Figure 7:
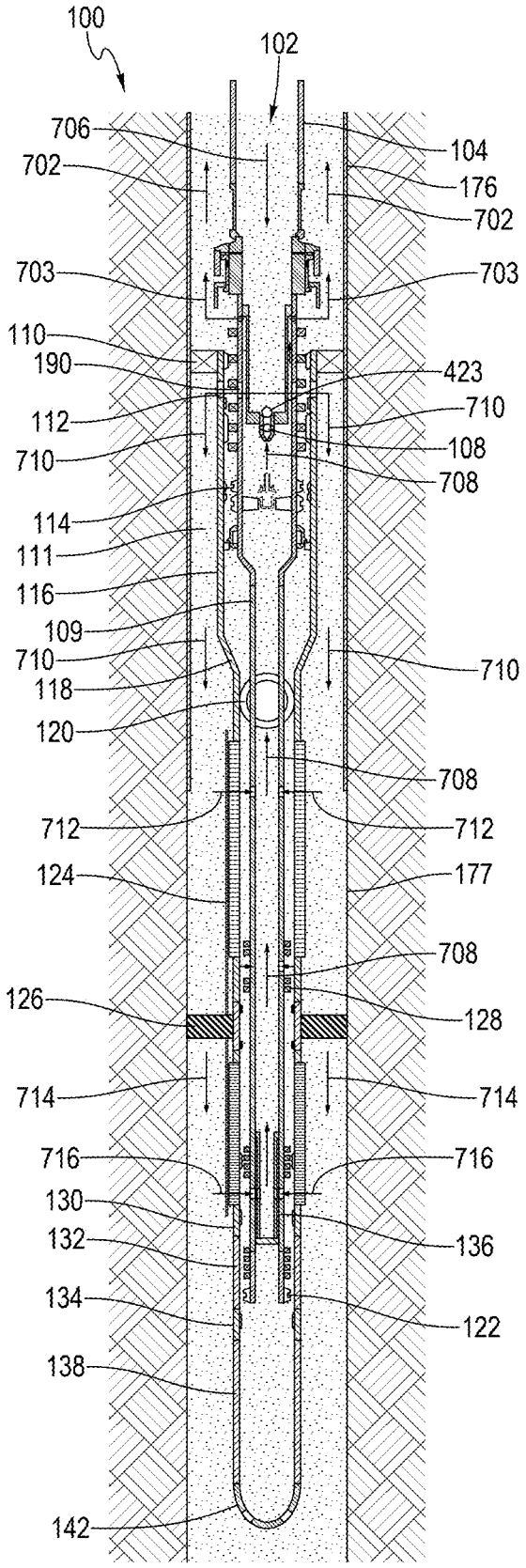
FIG. 7 is a cross sectional diagram of the OHGP MPD system of FIG. 1 that illustrates the open hole gravel pack pumping operation flow path, according to some implementations.

FIG. 7 is a cross sectional diagram of the OHGP MPD system of FIG. 1 that illustrates the open hole gravel pack pumping operation flow path, according to some implementations. A gravel-laden slurry may be pumped down through the crossover ports 190 and the MCS ports 112 into the annulus 111 between the shunt screen assembly 124 and the casing 176 and the wall 177 of the wellbore 102. This gravel packing down into the wellbore 102 is shown by a fluid flow 706 down the drill pipe 104 and out into the annulus 111 via the crossover ports 190 as shown by a fluid flow 710. A fluid flow 712 and 714 depict a return of the fluid inside the screen and wash pipe, respectively.

Figure 8:
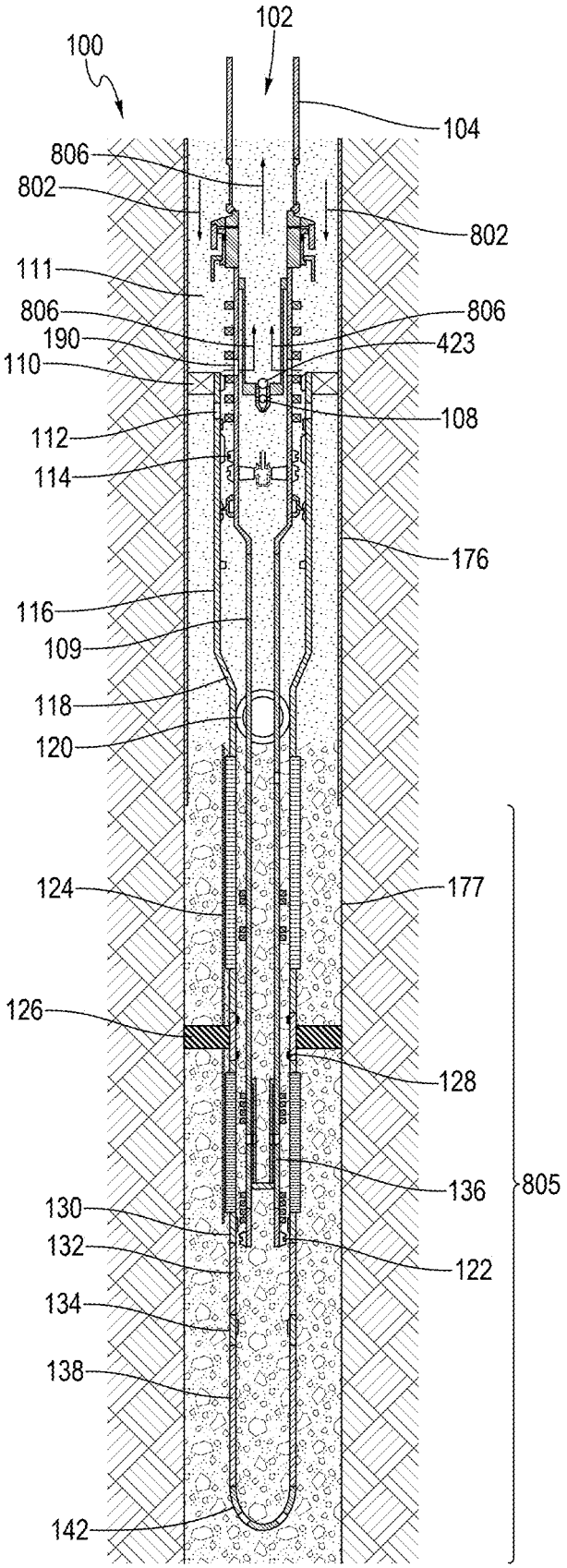
FIG. 8 is a cross sectional diagram of the OHGP MPD system of FIG. 1 that illustrates the reversing out of excess gravel pack slurry through the drill pipe, according to some implementations.

FIG. 8 is a cross sectional diagram of the OHGP MPD system of FIG. 1 that illustrates the reversing out of excess gravel pack slurry through the drill pipe, according to some implementations. In particular, once the gravel has been placed into position downhole (as shown by gravel pack 805), the service tool is moved to the reverse position such that the crossover ports 190 is above the gravel pack packer 110. Then the annulus 111 is pressured up to reverse out the excess sand in the drill pipe 104. This removal of the excess sand is shown by a fluid flow 802 down the annulus 111, a fluid flow 806 from the annulus 111 to inside the service tool via the crossover ports 190, and a fluid flow 806 back up the drill pipe 104.

Figure 9:
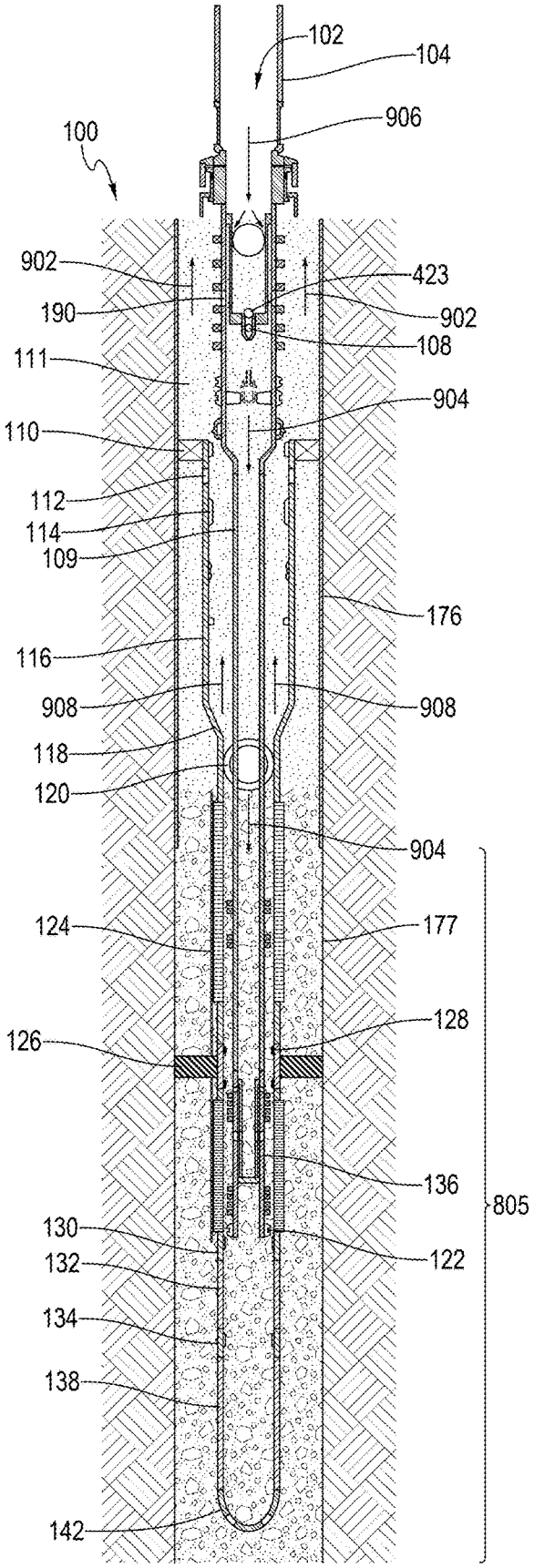
FIG. 9 is a cross sectional diagram of the OHGP MPD system of FIG. 1 that illustrates performing acid displacement, according to some implementations.

FIG. 9 is a cross sectional diagram of the OHGP MPD system of FIG. 1 that illustrates performing acid displacement, according to some implementations. In particular, FIG. 9 includes acid displacement which may include using acid (typically hydrochloric acid, hydrochloric (HCl), an acid blend, etc.) to displace the carrier fluid or mud from the formation face and near-wellbore area. This flow of acid is shown by a fluid flow 906 that is down the drill pipe 104, a fluid flow 904 below the back pressure valve 108. The flow of acid then returns back uphole as shown by a fluid flow 908 and back out to the annulus 111 above the gravel pack packer 110. In some implementations, a ball will be dropped to activate the flow diverter to convert the service tool to pump down to the end of the wash pipe.

Example Service Tools with Back Pressure Valve

Figure 10:
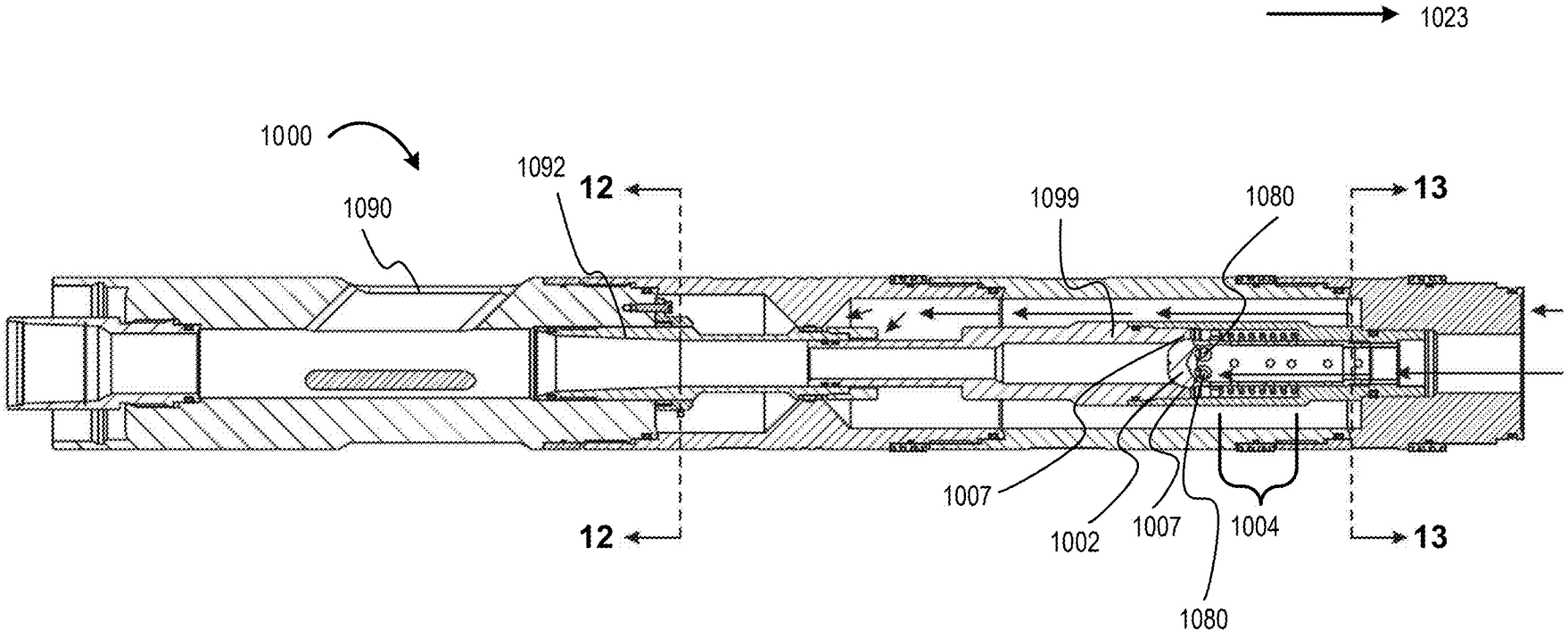
FIG. 10 is a cross sectional view of a service tool in a housing and having a valve positioned beneath the crossover ports (wherein the valve is closed), according to some implementations.

FIG. 10 is a cross sectional view of a service tool in a housing and having a valve positioned beneath the crossover ports (wherein the valve is closed), according to some implementations. As shown, FIG. 10 depicts a portion of a service tool 1000. The service tool 1000 depicted in FIGS. 10-11 and 14-15 is part of a service tool generally that may include additional components not depicted specifically in FIGS. 10-11 and 14-15. FIG. 10 depicts a first function of the service tool 1000 during run in hole (RIH). In particular, the first function includes allowing the service tool 1000 to hold backside pressure when the service tool 1000 is run in hole (RIH). For example, this RIH of the service tool 1000 may occur as part of an MPD application.

FIG. 10 depicts a portion of a service tool 1000 positioned in a housing 1099. The service tool 1000 includes a valve 1002 that is positioned below crossover ports 1090. The crossover ports 1090 are to provide fluid flow between an inner portion and an outer portion of the work string. In some implementations, the valve 1002 is a poppet. The valve 1002 may be a back pressure valve. The valve 1002 has a spherical face having shoulders 1007 that shoulder out on a tapered portion of the housing 1099. In some implementations, the spherical face and the tapered portion may be a metal-to-metal seal. In some implementations, the spherical face and the tapered portion may include other types of seals (e.g., rubber). The service tool 1000 also includes a spring 1004 positioned below the valve 1002 such that the spring 1004 may load the valve 1002 into the tapered portion (shoulder) of the housing 1099. The spring 1004 may provide a force on the valve 1002 to maintain the valve 1002 in the tapered portion of the housing 1099. The housing 1099 includes a ball seat 1092 into which a ball is to flow into from above (which is further described below). In some implementations, the valve 1002 is positioned below the crossover ports 1090. In some implementations, the valve 1002 is also positioned below the ball seat 1092. The service tool 1000 also includes ports 1080.

Figure 12:
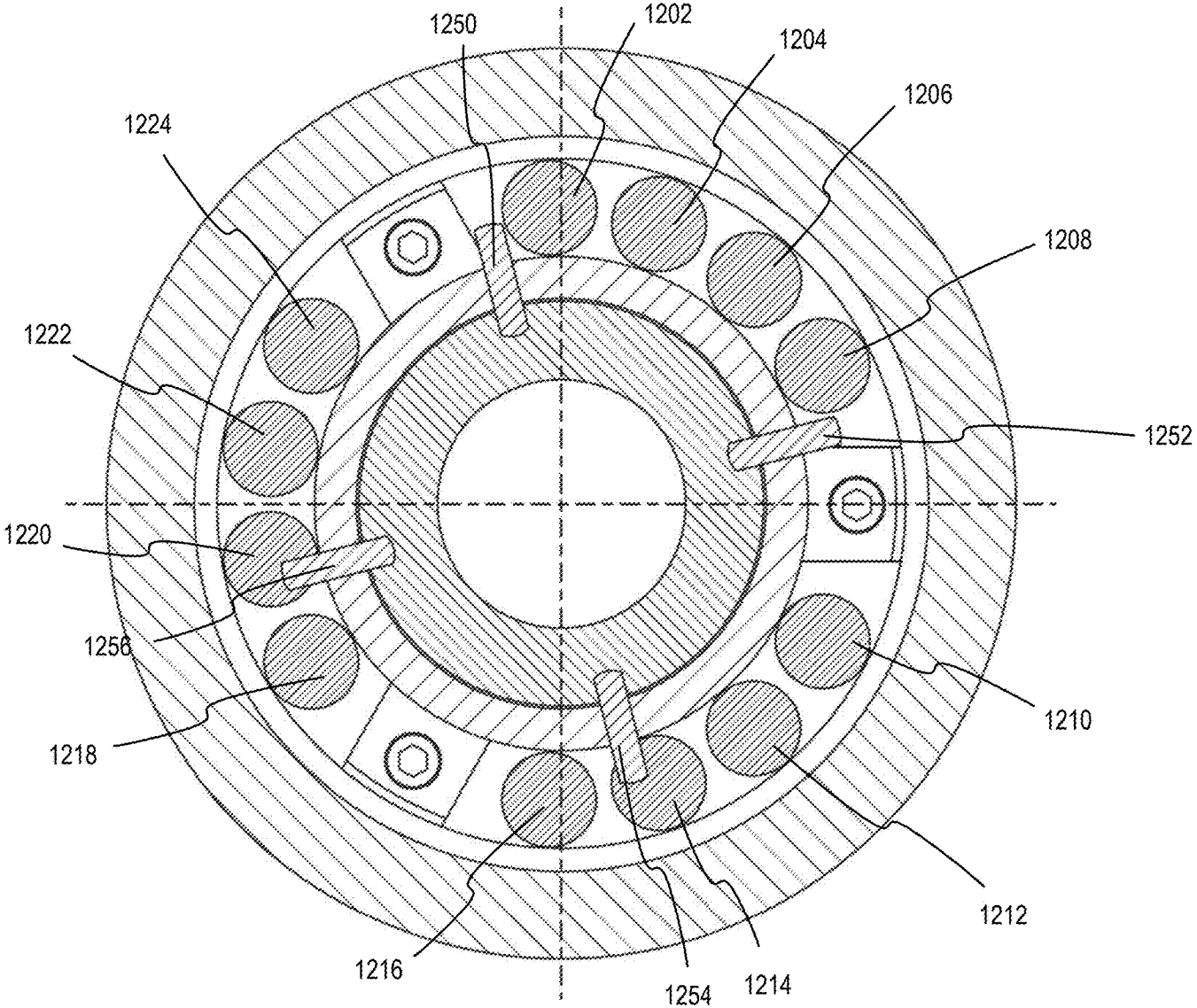
FIG. 12 is a cross sectional view 12-12 of the service tool of FIG. 10 looking up hole, according to some implementations.
Figure 13:
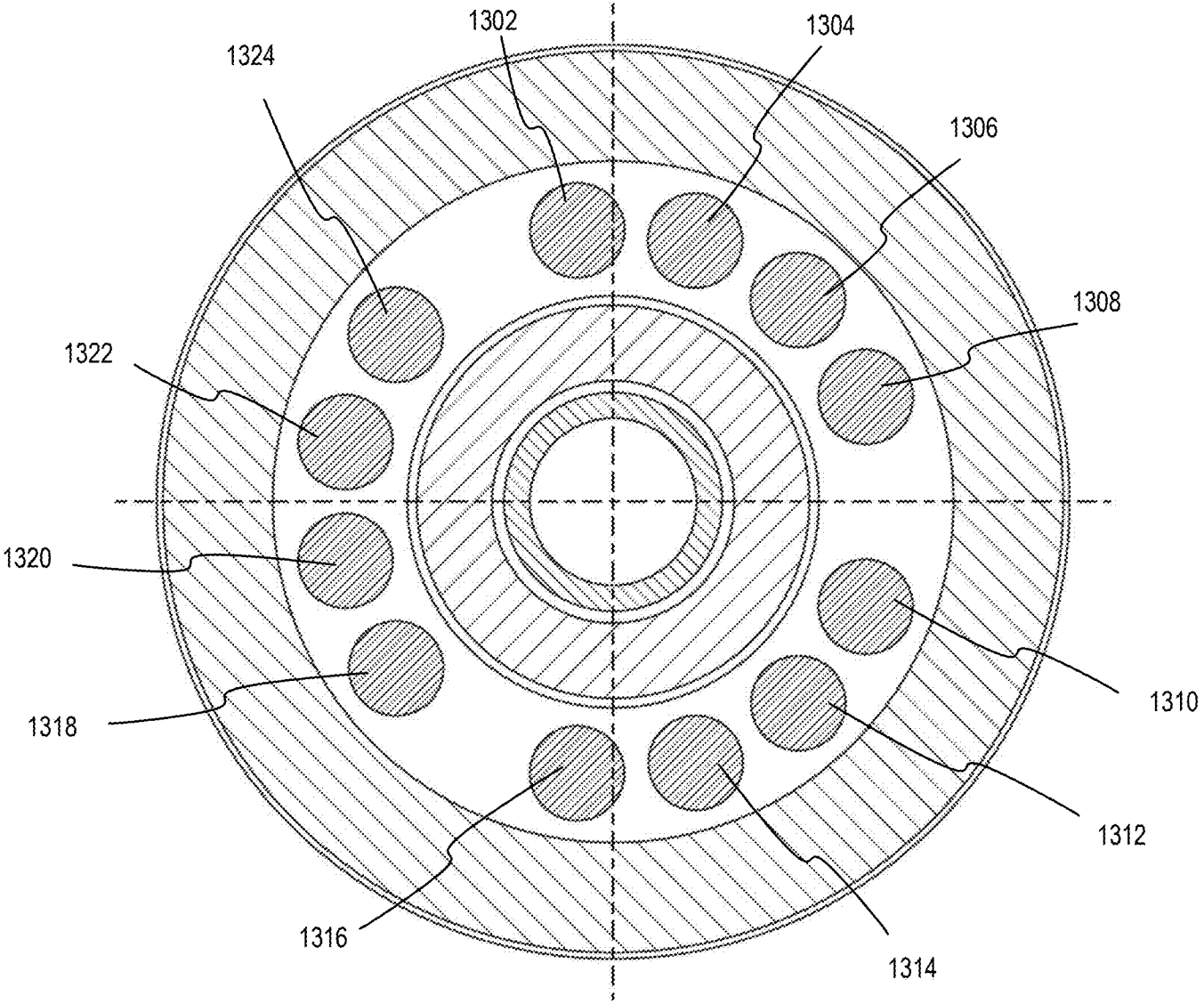
FIG. 13 is a cross sectional view 13-13 of the service tool of FIG. 10 looking down hole, according to some implementations.

FIG. 10 depicts a cutting plane 12-12 that is a cross-sectional view of the service tool 1000 which is depicted in FIG. 12 (which is further described below). FIG. 10 also depicts a cutting plane 13-13 that is a different cross-sectional view of the service tool 1000 which is depicted in FIG. 13 (which is further described below).

Figure 11:
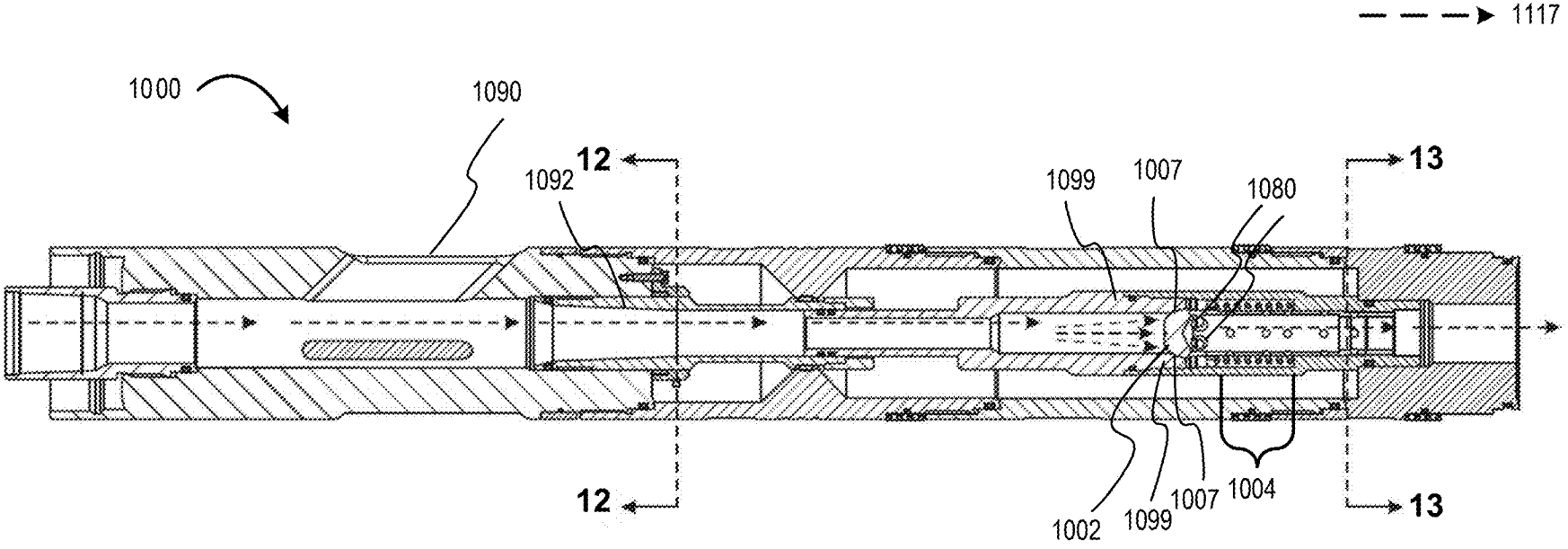
FIG. 11 is a cross sectional view of the service tool of FIG. 10 having a valve positioned beneath the crossover ports (such that the service tool is to provide well control, displacement or washdown during run in hole (RIH)), according to some implementations.

FIG. 11 is a cross sectional view of the service tool of FIG. 10 having a valve positioned beneath the crossover ports (such that the service tool is to provide well control, displacement or washdown during run in hole (RIH)), according to some implementations. FIG. 11 depicts the service tool 1000 when the service tool 1000 is run in hole (RIH). For example, this RIH of the service tool 1000 may occur as part of an MPD application. FIG. 11 depicts a second function of the service tool 1000 during RIH (as compared to the first function depicted in FIG. 10). In particular, the second function of the service tool 1000 during RIH depicted in FIG. 11 includes providing well control, displacement, or washdown.

The crossover ports 1090 are isolated in the MCS bore during RIH of the service tool 1000. As shown, a flow of fluid (a flow) 1117 is pumped down through the service tool 1000 such that the valve 1002 is pushed off seat-allowing for communication into a surrounding subsurface formation (around the wellbore). In particular, if a pressure from the flow 1117 of fluid onto the valve 1002 is greater than a threshold, the spring 1004 may move downward to enable the flow 1117 to flow around the valve 1002 down below. Thus, the pressure from the flow 1117 may cause the valve 1002 to be off seat (no longer having the seal between the valve 1002 and the tapered portion of the housing 1099). The flow 1117 may then flow through ports 1080.

FIG. 12 is a cross sectional view 12-12 of the service tool of FIG. 10 looking up hole, according to some implementations. FIG. 12 depicts fluid communication holes 1202-1224 and shear pins 1250-1256. A more detailed description of the fluid communication holes 1202-1224 and the shear pins 1250-1256 are provided below in reference to FIG. 14.

FIG. 13 is a cross sectional view 13-13 of the service tool of FIG. 10 looking down hole, according to some implementations. FIG. 13 depicts fluid communication holes 1302-1324. The fluid communication holes 1302-1324 enable a flow uphole and downhole below the valve 1002.

Figure 14:
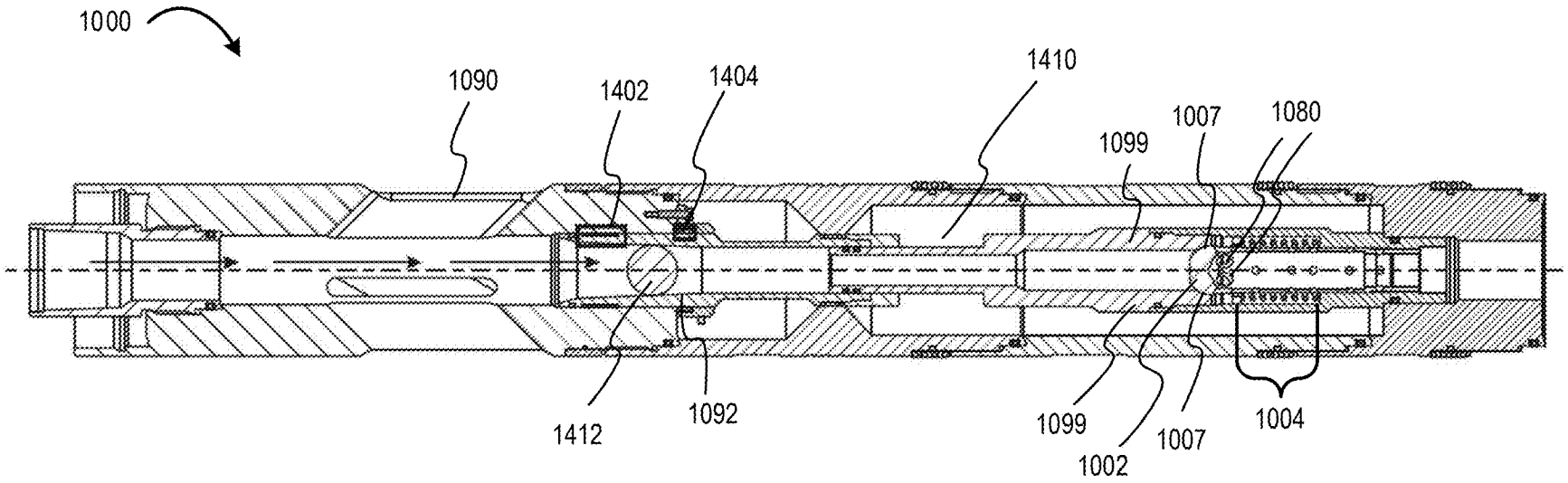
FIG. 14 is a cross-sectional view of the service tool of FIG. 10, after a ball is seated therein, according to some implementations.
Figure 15:
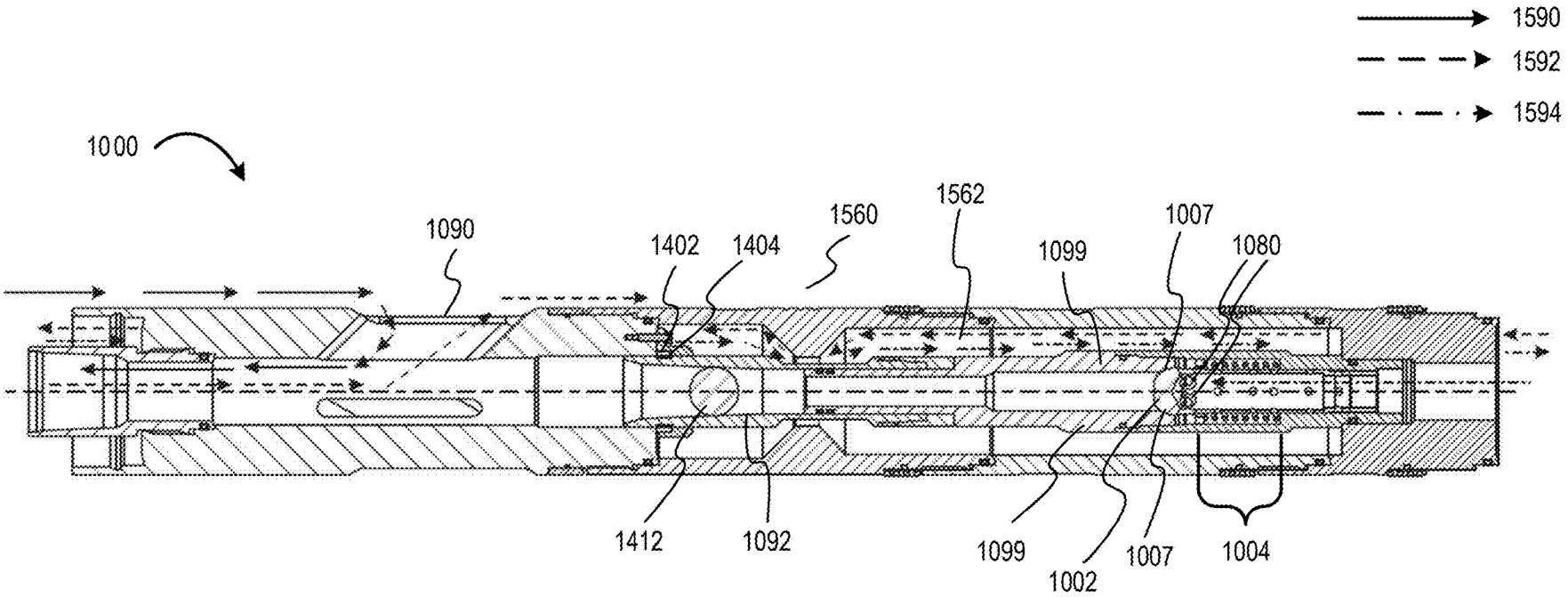
FIG. 15 is a cross-sectional view of the service tool of FIG. 10, after being shifted and locked into a position opening an annular flow path, according to some implementations.

FIG. 14 is a cross-sectional view of the service tool of FIG. 10, after a ball is seated therein, according to some implementations. FIG. 14 depicts the service tool 1000 wherein the service tool 1000 has the ability of the tool to set the gravel pack packer. The back pressure valve configuration of FIG. 14 is isolated in the MCS closing sleeve seal bore (no communication through the crossover ports 1090). FIG. 14 depicts a ball 1412 being flowed into the ball seat 1092 (which may be flowed a flow of fluid 1405 from a surface of the wellbore). Such implementations may allow for the pressure to build against the ball 1412 and outer seals which will set the gravel pack packer at a pre-determined pressure. In response, the shear pins 1250-1256 (depicted in FIG. 12) will be sheared. The service tool 1000 will then stroke down until a snap ring 1404 locks into a snap ring groove 1402. This will close a gap 1410 (thereby de-seating the outer seal and opening a communication pathway as shown in FIG. 15). Also, having the snap ring 1404 placed within the snap ring groove 1402 prevents the ball seat 1092 from moving back uphole.

FIG. 15 is a cross-sectional view of the service tool of FIG. 10, after being shifted and locked into a position opening an annular flow path, according to some implementations. In FIG. 15, the shear pins 1250-1256 have sheared; the service tool 1000 has stroked (closing the gap 1410 as shown in FIG. 14); and the snap ring 1404 has locked into the snap ring groove 1402.

Thus, a path for a flow of fluid 1592 is created for gravel packing (via the crossover ports 1090). This path allows proppant to be pumped through the crossover ports 1090 to an outer annulus 1560 and allows for returns through an inner annulus 1562. An additional path for a flow of fluid 1594 may provide for backside pressure being applied to test the gravel pack packer against a closed valve located further down in the service tool. This flow path also later allows for setting an open hole (OH) isolation packer between intervals (the poppet isolates backside pressure). FIG. 15 also depicts a path for a flow of fluid 1590 within the assembly that may allow for reversing out excess proppant once the gravel pack is complete as well as post gravel pack treatment of the filter cake in the formation.

Example Operations

Figure 16:
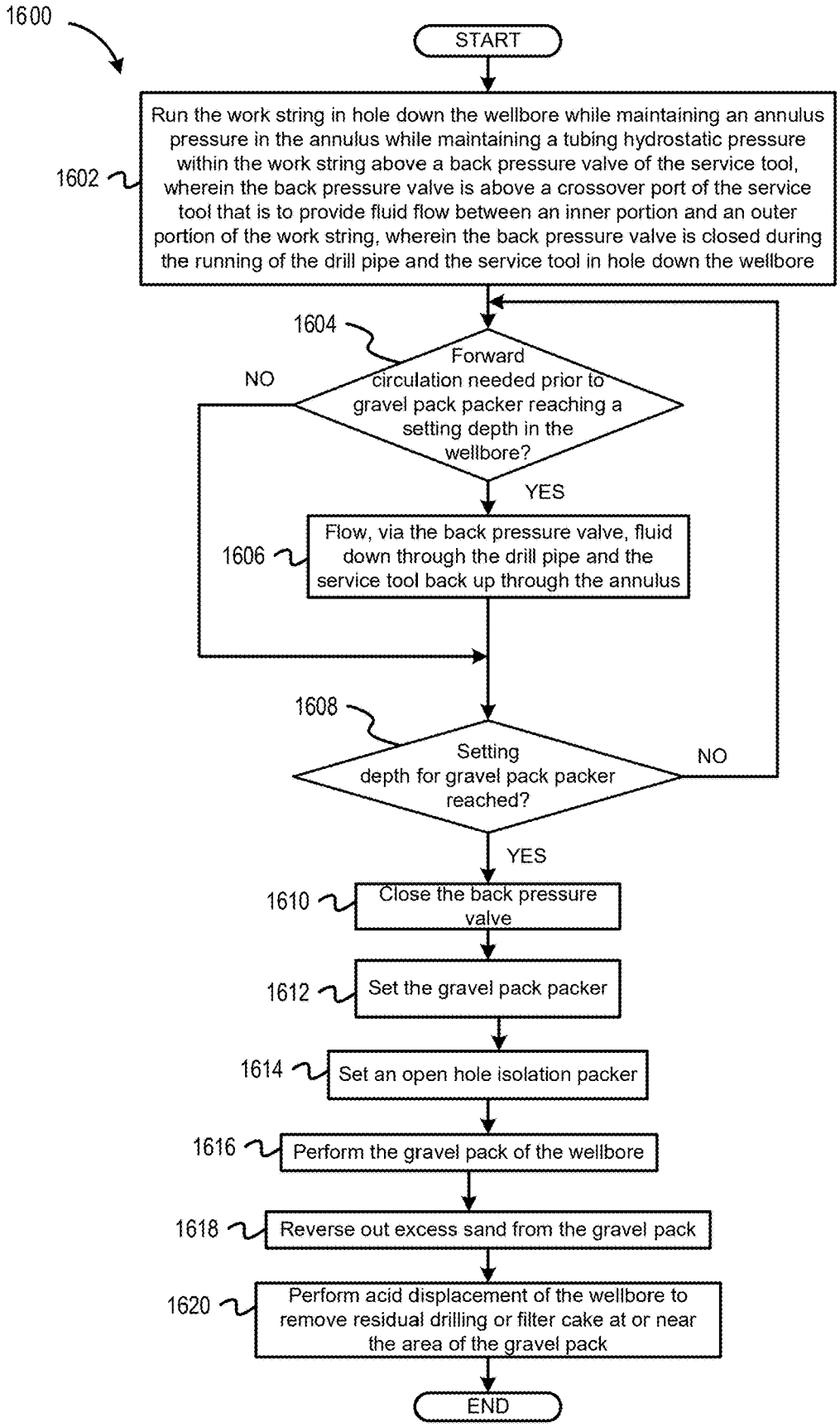
FIG. 16 is a block diagram of a flowchart of example operations for performing a gravel pack in an open hole wellbore for MPD operations, according to some implementations.

Example operations are now described. FIG. 16 is a block diagram of a flowchart of example operations for performing a gravel pack in an open hole wellbore for MPD operations, according to some implementations. Operations of a flowchart 1600 of FIG. 16 are described in reference to FIGS. 1-9. Operations of the flowchart 1600 start at block 1602.

At block 1602, the work string is run in hole (RIH) down the wellbore while maintaining an annulus pressure in the annulus while maintaining a hydrostatic pressure within the work string above a back pressure valve of the service tool, wherein the back pressure valve is above crossover ports of the service tool that is to provide fluid flow between an inner portion and an outer portion of the work string, wherein the back pressure valve is closed during the RIH of the drill pipe, the service tool, and lower completion the service tool. For example, with reference to FIG. 2, the work string is run in hole down the wellbore 102 while maintaining an annulus pressure in the annulus 111 and beneath the back pressure valve. Also, there is a hydrostatic pressure in the wellbore 102 that includes the area above the back pressure valve 108 and within the drill pipe 104.

At block 1604, a determination is made of whether forward circulation is needed prior to a gravel pack packer reaching a setting depth in the wellbore. For example, forward circulation may be needed to address one or more wellbore issues (such as well control, displacement, washdown, etc.). If forward circulation is needed prior to a gravel pack packer reaching a setting depth in the wellbore, operations of the flowchart 1600 continue at block 1606. Otherwise, operations of the flowchart 1600 continue at block 1608 (which is further described below).

At block 1606, fluid flows (via the back pressure valve) down through the drill pipe and the service tool back up through the annulus. For example, with reference to FIG. 3, if forward circulation is needed, a fluid may be pumped down through the work string to open the back pressure valve 108. In FIG. 3, this fluid flow is shown by a fluid flow 306 down through the drill pipe 104 to cause the back pressure valve 108 to open-thereby causing a fluid flow 304 down through the back pressure valve 108. The fluid flow 304 then flows out of a port 303 and out into the annulus 111 (shown as a fluid flow 302). Such a forward circulation down through the work string may resolve the wellbore issue without any intervention or applied opening pressure. Additionally, this process may be repeated multiple times.

At block 1608, a determination is made of whether the gravel pack packer has reached its setting depth. The setting depth may be a defined depth within the wellbore where the gravel pack packer is to be positioned. For example, FIG. 4 depict an OHGP MPD system when a setting depth in the wellbore 102 for the gravel pack packer 110 has been reached. If the setting depth has not been reached, operations of the flowchart 1600 remain at block 1604 to determine if forward circulation is needed. If the setting depth has been reached, operations of the flowchart 1600 continue at block 1610.

At block 1610, the back pressure valve is closed. For example, with reference to FIG. 4, a setting object (e.g., a ball) 423 is included in fluid flow 406 (that flows down through the drill pipe 104) so that the setting object 423 is dropped onto the back pressure valve 108 to close the back pressure valve 108. When the setting object 423 lands in the seat, it will seal and isolate the back pressure valve 108. This will result in a building of pressure above the setting object 423 to set the packer. Additionally, the pressure in the area that includes the annulus 111 and below the back pressure valve 108) remains unchanged (the annulus pressure).

At block 1612, the gravel pack packer is set. For example, with reference to FIG. 4, after reaching the setting depth, the gravel pack packer 110 is set within the wellbore 102. In some implementations, the gravel pack packer may be tested prior to gravel packing. Such testing ensures that the gravel pack packer is properly set. For example, with reference to FIG. 5, a fluid flow 502 flows down the annulus 111 from a surface of the wellbore 102 to ensure that the gravel pack packer 110 is properly set within the wellbore.

At block 1614, an open hole isolation packer is set in the annulus. For example, with reference to FIG. 6, the open hole isolation packer 126 is set against the wall 177 of the wellbore 102. Additionally, the back pressure valve 108 maintains the back pressure while the open hole isolation packer 126 is being set. FIG. 6 also depicts a fluid flow 602 down the annulus 111 above the gravel pack packer 110 that has been set and a fluid flow 606.

At block 1616, gravel packing of the wellbore is performed. For example, with reference to FIG. 7, a gravel-laden slurry may be pumped down through the crossover ports 190 into the annulus 111 between a screen and a wall of the wellbore 102. This gravel packing down into the wellbore 102 is shown by a fluid flow 706 down the drill pipe 104 and out into the annulus 111 via the crossover ports 190 as shown by a fluid flow 710. The gravel-laden slurry being gravel packed is also shown by a fluid flow 712 and 714.

At block 1618, excess sand is reversed out from the gravel pack. For example, with reference to FIG. 8, once the gravel has been placed into position downhole (as shown by gravel pack 805), the service tool is moved to the reverse position such that the crossover ports 190 is above the gravel pack packer 110. Then the annulus 111 is pressured up to reverse out the excess sand in the drill pipe 104. This removal of the excess sand is shown by a fluid flow 802 down the annulus 111, a fluid flow 806 from the annulus 111 to inside the service tool via the crossover ports 190, and a fluid flow 806 back up the drill pipe 104.

At block 1620, acid displacement of the wellbore is performed to remove residual drilling or filter cake at or near the area of the gravel pack. For example, with reference to FIG. 9, acid displacement may include using acid (typically hydrochloric acid, hydrochloric (HCl), an acid blend, etc.) to displace the carrier fluid or mud from the formation face and near-wellbore area. This flow of acid is shown by a fluid flow 906 that is down the drill pipe 104, a fluid flow 904 below the back pressure valve 108. The flow of acid then returns back uphole as shown by a fluid flow 908 and back out to the annulus 111 above the gravel pack packer 110.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

While the aspects of the disclosure are described with reference to various implementations and exploitations, it will be understood that these aspects are illustrative and that the scope of the claims is not limited to them. In general, techniques for pulse power drilling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE IMPLEMENTATIONS

Implementation #1: A method of managing pressure in a wellbore having an annulus defined between a wall of the wellbore and a work string that includes drill pipe, a service tool, and a lower completion, the method comprising: performing the following operations, running the work string in hole down the wellbore while maintaining an annulus pressure while maintaining a hydrostatic pressure within the work string above a valve of the service tool, wherein the valve is configured to pressurize the annulus without pressurizing the work string.

Implementation #2: The method of Implementation #1, wherein the valve is to be positioned below a crossover port of the service tool that is to provide fluid flow between an inner portion and an outer portion of the work string.

Implementation #3: The method of any one of Implementations #1-2, wherein the valve is configurable to be opened to pump a fluid down the work string.

Implementation #4: The method of any one of Implementations #1-3, wherein the valve is closed during the running of the drill pipe, the service tool, and the lower completion in hole down the wellbore to prevent collapse of an open hole portion of the wellbore.

Implementation #5: The method of any one of Implementations #1-4, wherein performing the following operations comprises, in response to determining a forward circulation is needed to correct a wellbore issue prior to a gravel pack packer of the work string reaching a setting depth in the wellbore, flowing, via the valve, fluid down through the drill pipe and the service tool back up through the annulus.

Implementation #6: The method of Implementation #5, wherein the wellbore issue comprises at least one of well control, displacement, or washdown.

Implementation #7: The method of Implementation #5, wherein performing the following operations comprises, in response to the gravel pack packer reaching the setting depth in the wellbore, closing the back up pressure valve; and setting the gravel pack packer with pressure down the work string.

Implementation #8: The method of Implementation #7, wherein closing the valve comprises dropping an object down the drill pipe and onto the valve.

Implementation #9: The method of Implementation #7, wherein performing the following operations comprises, after setting the gravel pack packer, setting an open hole isolation packer; and performing a gravel pack of the wellbore.

Implementation #10: The method of Implementation #9, wherein performing the following operations comprises, after setting the gravel pack packer, reversing out excess sand from the gravel pack; and performing acid displacement of the wellbore to remove residual drilling or filter cake at or near the gravel pack.

Implementation #11: The method of any one of Implementations #1-10, wherein the valve comprises a back pressure valve.

Implementation #12: The method of any one of Implementations #1-11, wherein the valve comprises a remotely operable valve.

Implementation #13: A method comprising: managing pressure in a wellbore having an annulus defined between a wall of the wellbore and a work string that includes a drill pipe, a service tool and a lower completion, wherein managing the pressure in the wellbore comprises, performing the following operations, running the work string in hole down the wellbore while maintaining an annulus pressure in the annulus while maintaining a hydrostatic pressure within the work string above a valve of the service tool, wherein the valve is configured to pressurize the annulus without pressurizing the work string wherein the valve is closed during the running of the drill pipe, the service tool, and lower completion in hole down the wellbore.

Implementation #14: The method of Implementation #13, wherein the valve is to be positioned below a crossover port of the service tool that is to provide fluid flow between an inner portion and an outer portion of the work string.

Implementation #15: The method of any one of Implementations #13-14, wherein the valve is configurable to be opened to pump a fluid down the work string.

Implementation #16: The method of any one of Implementations #13-15, wherein performing the following operations comprises, in response to determining a forward circulation is needed to correct a wellbore issue prior to a gravel pack packer of the work string reaching a setting depth in the wellbore, flowing, via the valve, fluid down through the drill pipe and the service tool back up through the annulus, wherein the wellbore issue comprises at least one of well control, displacement, or washdown.

Implementation #17: The method of Implementation #16, wherein performing the following operations comprises, in response to the gravel pack packer reaching the setting depth in the wellbore, closing the valve; and setting the gravel pack packer.

Implementation #18: The method of Implementation #17, wherein performing the following operations comprises, after setting the gravel pack packer, setting an open hole isolation packer; performing a gravel pack of the wellbore; reversing out excess sand from the gravel pack; and performing acid displacement of the wellbore to remove residual drilling or filter cake at or near the gravel pack.

Implementation #19: The method of any one of Implementations #13-18, wherein the valve comprises a back pressure valve.

Implementation #20: The method of any one of Implementations #13-19, wherein the valve comprises a remotely operable valve.

Implementation #21: A method comprising: managing pressure in a wellbore having an annulus defined between a wall of the wellbore and a work string that includes a drill pipe, a service tool and a lower completion, wherein managing the pressure in the wellbore comprises, performing the following operations, running the work string in hole down the wellbore while maintaining an annulus pressure in the annulus while maintaining a hydrostatic pressure within the work string above a back pressure valve of the service tool, wherein the back pressure valve is configured to pressurize the annulus without pressurizing the work string, wherein the back pressure valve is above a crossover port of the service tool that is to provide fluid flow between an inner portion and an outer portion of the work string.

Implementation #22: The method of Implementation #21, wherein the back pressure valve is configurable to be opened to pump a fluid down the work string.

Implementation #23: The method of any one of Implementations #21-22, wherein the back pressure valve is closed during the running of the drill pipe, the service tool, and the lower completion in hole down the wellbore.

Implementation #24: The method of any one of Implementations #21-23, wherein performing the following operations comprises, in response to determining a forward circulation is needed to correct a wellbore issue prior to a gravel pack packer of the work string reaching a setting depth in the wellbore, flowing, via the back pressure valve, fluid down through the drill pipe and the service tool back up through the annulus, wherein the wellbore issue comprises at least one of well control, displacement, or washdown.

Implementation #25: The method of Implementation #24, wherein performing the following operations comprises, in response to the gravel pack packer reaching the setting depth in the wellbore, closing the back pressure valve; setting the gravel pack packer; after setting the gravel pack packer, setting an open hole isolation packer; performing a gravel pack of the wellbore; reversing out excess sand from the gravel pack; and performing acid displacement of the wellbore to remove residual drilling or filter cake at or near the gravel pack.

Implementation #26: An apparatus comprising: a service tool configured to be deployed in a wellbore as part of a managed pressure drilling operation of the wellbore, wherein an annulus is defined between a wall of the wellbore and a work string that includes the service tool, a drill pipe, and a lower completion, the service tool comprising, a crossover port; and a valve configured to maintain a back side pressure in the annulus without pressurizing the work string.

Implementation #27: The apparatus of Implementation #26, wherein the valve is to be positioned below the crossover port.

Implementation #28: The apparatus of any one of Implementations #26-27, wherein the valve is configurable to be opened to pump a fluid down the work string.

Implementation #29: The apparatus of any one of Implementations #26-28, wherein the valve is a back pressure valve.

Implementation #30: The apparatus of any one of Implementations #26-29, wherein the valve is to be closed while the service tool is run in hole down into the wellbore.

Implementation #31: The apparatus of any one of Implementations #26-30, wherein a range of the back side pressure is between a pore pressure and a fracture pressure for a surrounding formation into which the wellbore is formed.

Implementation #32: The apparatus of any one of Implementations #26-31, wherein the valve is configured to maintain a hydrostatic pressure in an area in the service tool above the valve, while the service tool is run in hole down into the wellbore.

Implementation #33: The apparatus of Implementation #32, wherein in response to a determination that forward circulation is needed to correct a wellbore issue, prior to a gravel pack packer reaching a setting depth in the wellbore, a pump is configured to pump fluid down the drill pipe to open the valve such that a pressure in the area in the service tool above the valve and in the drill pipe is substantially the same as the back side pressure.

Implementation #34: The apparatus of Implementation #33, wherein the wellbore issue comprises at least one of well control, displacement, or wash down.

Implementation #35: The apparatus of Implementation #33, wherein the valve is configured to be closed in response to the gravel pack packer reaching the setting depth.

Implementation #36: The apparatus of Implementation #35, wherein an object is to be dropped down the drill pipe and onto the valve to close the valve in response to the gravel pack packer reaching the setting depth.

Implementation #37: The apparatus of Implementation #35, wherein in response to the valve being closed, the area in the service tool above the valve returns to the hydrostatic pressure.

Implementation #38: The apparatus of Implementation #37, wherein the gravel pack packer is configured to be set after the setting depth is reached.

Implementation #39: The apparatus of Implementation #38, wherein after the gravel pack packer is set, an open hole isolation packer is set, a gravel pack of the wellbore is performed, excess sand is to be reversed out from the gravel pack; and an acid displacement of the wellbore is performed to remove residual drilling or filter cake at or near the gravel pack.

Implementation #40: An apparatus comprising: a service tool configured to be deployed in a wellbore as part of a managed pressure drilling operation of the wellbore, wherein an outer annulus is defined between a wall of the wellbore and a work string that includes the service tool, a drill pipe, and a lower completion, the service tool comprising, a crossover port; a ball seat configured to receive a ball from uphole such that after receipt of the ball a pressure is exceeded from a fluid flow to cause at least one shear pin to shear such that the service tool is to stroke down to create a fluid communication path for proppant to be pumped through the crossover port and a return back through an inner annulus, as part of gravel packing; and a valve positioned configured to maintain a back side pressure in the outer annulus without pressurizing the work string.

Implementation #41: The apparatus of Implementation #40, wherein the valve is to be positioned below the crossover port.

Implementation #42: The apparatus of any one of Implementations #40-41, wherein the valve is configurable to be opened to pump a fluid down the work string.

Implementation #43: The apparatus of any one of Implementations #40-42, wherein the valve is configured to maintain a hydrostatic pressure in an area in the service tool above the valve and in the drill pipe, while the service tool is run in hole down into the wellbore.

Implementation #44: The apparatus of Implementation #43, wherein in response to a determination that forward circulation is needed to correct a wellbore issue, prior to a gravel pack packer reaching a setting depth in the wellbore, a pump is configured to pump fluid down the drill pipe to open the valve such that a pressure in the area in the service tool above the valve and in the drill pipe is substantially the same as the back side pressure, wherein the wellbore issue comprises at least one of well control, displacement, or wash down.

Implementation #45: The apparatus of Implementation #44, wherein the valve is configured to be closed in response to the gravel pack packer reaching the setting depth, wherein an object is to be dropped down the drill pipe and onto the valve to close the valve in response to the gravel pack packer reaching the setting depth.

Implementation #46: The apparatus of Implementation #45, wherein in response to the valve being closed, the area in the service tool above the valve and in the drill pipe returns to the hydrostatic pressure, wherein the gravel pack packer is configured to be set after the setting depth is reached.

Implementation #47: The apparatus of Implementation #46, wherein after the gravel pack packer is set, an open hole isolation packer is set, a gravel pack of the wellbore is performed, excess sand is to be reversed out from the gravel pack; and an acid displacement of the wellbore is performed to remove residual drilling or filter cake at or near the gravel pack.

Implementation #48: A system comprising: a work string to be deployed downhole in a wellbore wherein an annulus is defined between a wall of the wellbore and the work string, the work string comprising, a drill pipe; a lower completion; and a service tool configured to be coupled below the drill pipe as part of a managed pressure drilling operation of the wellbore the service tool comprising, a crossover port; and a valve to be positioned below the crossover port and within the service tool, wherein the valve is configured to maintain a back side pressure in the annulus without pressurizing the work string.

Implementation #49: The system of Implementation #48, wherein the valve is to be positioned below the crossover port.

Implementation #50: The system of any one of Implementations #48-49, wherein the valve is configurable to be opened to pump a fluid down the work string.

Implementation #51: The system of any one of Implementations #48-50, wherein the valve is configured to maintain a hydrostatic pressure in an area in the service tool above the valve and in the drill pipe, while the service tool is run in hole down into the wellbore, wherein in response to a determination that forward circulation is needed to correct a wellbore issue, prior to a gravel pack packer reaching a setting depth in the wellbore, a pump is configured to pump fluid down the drill pipe to open the valve such that a pressure in the area in the service tool above the valve and in the drill pipe is substantially the same as the back side pressure, wherein the wellbore issue comprises at least one of well control, displacement, or wash down.

The invention claimed is:

1. An apparatus comprising:

a service tool configured to be deployed in a wellbore as part of a managed pressure drilling operation of the wellbore, wherein, when the service tool is deployed in the wellbore, an annulus is defined between a wall of the wellbore and a work string that includes the service tool, and a drill pipe, the service tool comprising, a crossover port; and a valve configured to maintain a back side pressure in the annulus without pressurizing the work string, and, in response to a determination that forward circulation is needed and prior to a gravel pack packer reaching a setting depth in the wellbore, configured to open when fluid is pumped down the drill pipe so that a pressure in the area of the service tool above the valve and in the drill pipe is substantially the same as the back side pressure, and configured to close after receiving a setting object.

2. The apparatus of claim 1, wherein the valve is to be positioned below the crossover port.

3. The apparatus of claim 1, wherein the valve is configurable to be opened to pump a fluid down the work string.

4. The apparatus of claim 1, wherein the valve is a back pressure valve.

5. The apparatus of claim 1, wherein the valve is to be closed while the service tool is run in hole down into the wellbore.

6. The apparatus of claim 1, wherein a range of the back side pressure is between a pore pressure and a fracture pressure for a surrounding formation into which the wellbore is formed.

7. The apparatus of claim 1, wherein the valve is configured to maintain a hydrostatic pressure in an area in the service tool above the valve, while the service tool is run in hole down into the wellbore.

8. The apparatus of claim 7, wherein the valve is configured to be closed in response to the gravel pack packer reaching the setting depth.

9. The apparatus of claim 8, further comprising the setting object, wherein the setting object is to be dropped down the drill pipe and onto the valve to close the valve in response to the gravel pack packer reaching the setting depth.

10. The apparatus of claim 8, wherein in response to the valve being closed, the area in the service tool above the valve returns to the hydrostatic pressure.

11. The apparatus of claim 10, further comprising the gravel pack packer, wherein the gravel pack packer is configured to be set after the setting depth is reached.

12. An apparatus comprising:

a service tool configured to be deployed in a wellbore as part of a managed pressure drilling operation of the wellbore, wherein, when the service tool is deployed in the wellbore, an outer annulus is defined between a wall of the wellbore and a work string that includes the service tool, and a drill pipe, the service tool comprising, a crossover port;

a ball seat configured to receive a ball from uphole such that after receipt of the ball a pressure is exceeded from a fluid flow to cause at least one shear pin to shear such that the service tool is to stroke down to create a fluid communication path for proppant to be pumped through the crossover port and a return back through an inner annulus, as part of gravel packing; and a valve configured to maintain a back side pressure in the outer annulus without pressurizing the work string, and, in response to a determination that forward circulation is needed and prior to a gravel pack packer reaching a setting depth in the wellbore, configured to open when fluid is pumped down the drill pipe so that a pressure in the area of the service tool above the valve and in the drill pipe is substantially the same as the back side pressure, and configured to close after receiving a setting object.

13. The apparatus of claim 12, wherein the valve is to be positioned below the crossover port.

14. The apparatus of claim 12, wherein the valve is configurable to be opened to pump a fluid down the work string.

15. The apparatus of claim 12, wherein the valve is configured to maintain a hydrostatic pressure in an area in the service tool above the valve and in the drill pipe, while the service tool is run in hole down into the wellbore.

16. The apparatus of claim 15, wherein the valve is configured to be closed in response to the gravel pack packer reaching the setting depth, further comprising the setting object, wherein the setting object is to be dropped down the drill pipe and onto the valve to close the valve in response to the gravel pack packer reaching the setting depth.

17. The apparatus of claim 16, wherein in response to the valve being closed, the area in the service tool above the valve and in the drill pipe returns to the hydrostatic pressure, further comprising the gravel pack packer, wherein the gravel pack packer is configured to be set after the setting depth is reached.

18. A system comprising:

a work string to be deployed downhole in a wellbore wherein, when the work string is deployed in the wellbore, an annulus is defined between a wall of the wellbore and the work string, the work string comprising, a drill pipe;

a lower completion; and a service tool configured to be coupled below the drill pipe to the lower completion as part of a managed pressure drilling operation of the wellbore, the service tool comprising, a crossover port; and a valve to be positioned below the crossover port and configured to maintain a back side pressure in the annulus without pressurizing the work string, and, in response to a determination that forward circulation is needed and prior to a gravel pack packer reaching a setting depth in the wellbore, configured to open when fluid is pumped down the drill pipe so that a pressure in the area of the service tool above the valve and in the drill pipe is substantially the same as the back side pressure, and configured to close after receiving a setting object.

19. The system of claim 18, wherein the valve comprises a back pressure valve.

20. The system of claim 18, wherein the valve is configurable to be opened to pump a fluid down the work string.

21. The system of claim 18, wherein the valve is configured to maintain a hydrostatic pressure in an area in the service tool above the valve and in the drill pipe, while the service tool is run in hole down into the wellbore.

* * * * *